United States Patent [19]

Peppiatt

[11] 4,252,269

[45] Feb. 24, 1981

[54] PLASTIC BAG WITH CARRYING HANDLE

[75] Inventor: Harry R. Peppiatt, Doylestown, Pa.

[73] Assignee: Paramount Packaging, Chalfont, Pa.

[21] Appl. No.: 25,703

[22] Filed: Apr. 2, 1979

[51] Int. Cl.[3] ..... B65D 30/00; B65D 33/06

[52] U.S. Cl. ..... 229/54 R; 150/12

[58] Field of Search ..... 229/52 A, 52 B, 54 R, 229/58, 54; 150/12

[56] References Cited

U.S. PATENT DOCUMENTS

| | | | |
|---|---|---|---|
| 1,897,910 | 2/1933 | Malvern et al. | 229/54 R |
| 3,128,035 | 4/1964 | Teweles | 229/54 R |
| 3,240,420 | 3/1966 | Membrino | 229/54 R |
| 3,348,761 | 10/1967 | Vetter | 229/54 R |
| 3,370,630 | 2/1968 | Haugh et al. | 150/12 |
| 3,383,029 | 5/1968 | Reade | 229/52 A |
| 3,430,845 | 3/1969 | Susuki et al. | 229/52 B |
| 3,484,037 | 12/1969 | Kugler | 229/54 R |

*Primary Examiner*—Allan N. Shoap

*Attorney, Agent, or Firm*—Seidel, Gonda, Goldhammer & Panitch

[57] ABSTRACT

A bag of polymeric plastic material has an opening at one end and a gusset at the opposite end. Within the gusset there is disposed a handle welded to front and rear panels of the bag along a fold line. The handle is shorter than the length of the gusset.

5 Claims, 8 Drawing Figures

FIG. 1
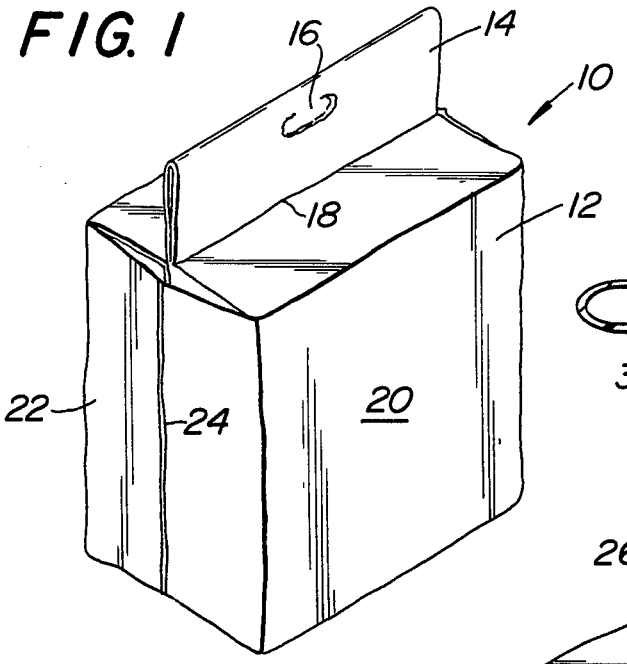
FIG. 4
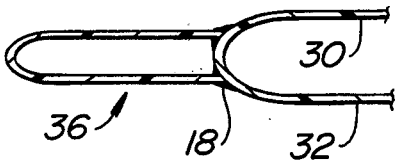
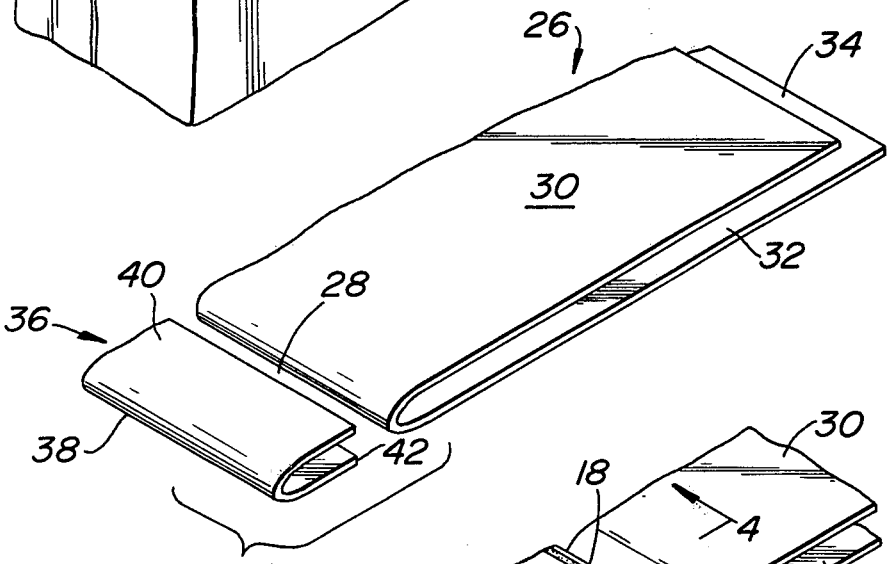
FIG. 2
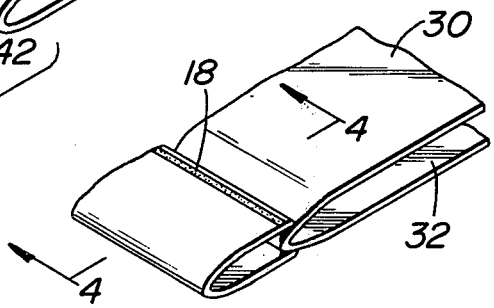
FIG. 3

FIG. 5
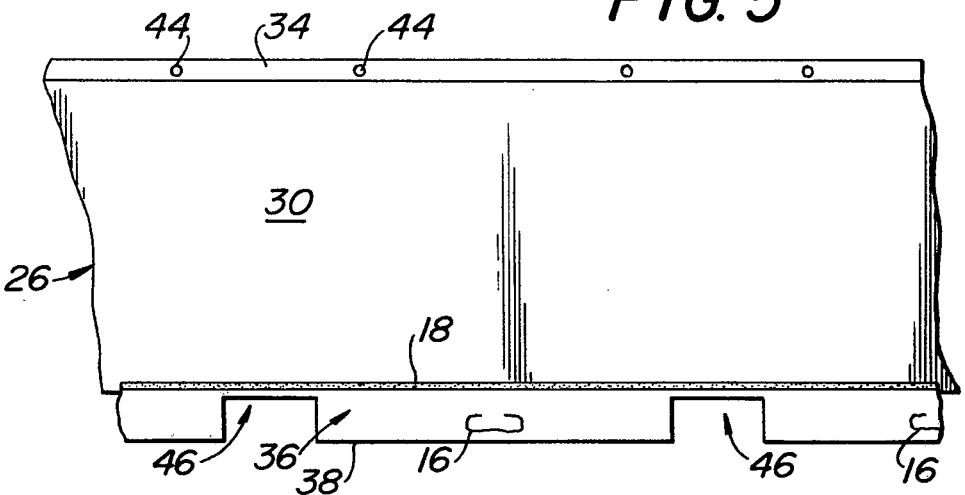
FIG. 7
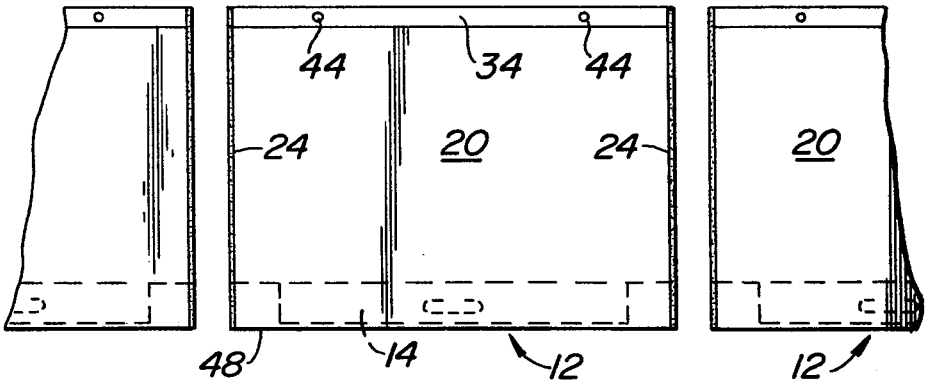
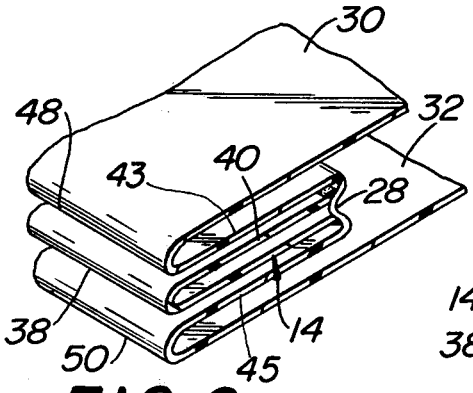
FIG. 6
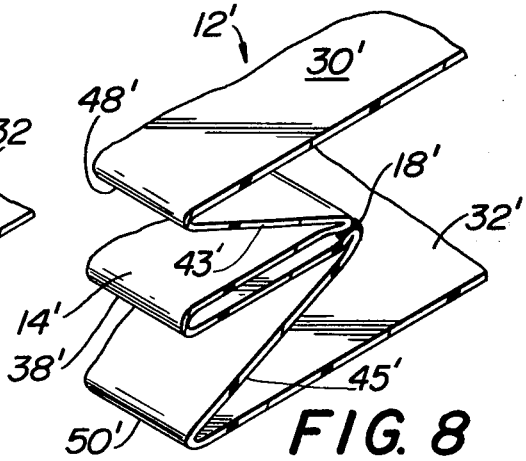
FIG. 8

PLASTIC BAG WITH CARRYING HANDLE

BACKGROUND

Bags of the general type involved herein wherein the handle is disposed within a gusset are known from U.S. Pat. No. 3,370,630. In said patent, the handle is disposed within the gusset but is welded to the bag only at the ends of the handle. The welds at the side edges of the bag in said patent, in the area of the handle, have six layers of material whereby the thickness of material which can be used is limited. Further, by providing welds only at the end of the handles along the side edge of the bag, a package does not have a smooth layer of plastic material on the end thereof adjacent the handle.

The methods for continuously producing bags of the general type involved herein including devices for forming gussets in a continuously moving web are known to those skilled in the art and may be of the type disclosed in U.S. Pat. Nos. 3,282,173 and 3,481,051. This disclosure assumes familiarity with the teachings in said patents.

SUMMARY OF THE INVENTION

One aspect of the present invention is a bag having front and rear panels integral in one piece at a fold line with a gusset at one end, welds joining side edges of said panels, the other end of said bag being open to facilitate introducing goods into the bag, a handle disposed in said gusset and having a length shorter than the length of said fold line, said handle being welded to said panels along said fold line, said handle having an opening to facilitate carrying the bag.

The bag of the present invention is preferably made in the following manner. A web is folded to form overlapping panels with a fold line. A handle strip is welded to panels. The handle strip is then die cut to provide notches in the handle strip up to a point adjacent the weld thereby defining discrete handles, then the panels are folded about the weld to form a gusset along one edge in a manner so that the handles are in the gusset. Thereafter, the thusly folded web is cut transversely and simultaneously welding side edges of the panels together at the notches so that the side edges of a bag are spaced from the ends of its handle.

It is an object of the present invention to provide a novel bag and method of making the same.

Other objects will appear hereinafter.

For the purpose of illustrting the invention, there is shown in the drawings a form which is presently preferred; it being understood, however, that this invention is not limited to the precise arrangements and instrumentalities shown.

FIG. 1 is a perspective view of a package.

FIG. 2 is a partial perspective view of two webs which have been folded and are about to be welded.

FIG. 3 is a partial perspective view showing the two webs welded.

FIG. 4 is a sectional view taken along the line 4—4 in FIG. 3.

FIG. 5 is a plan view of the welded webs wherein the handle web has been notched and die cut.

FIG. 6 is a partial perspective view showing the subsequent folding step.

FIG. 7 is a plan view of the web with welds being provided transversely to define welded side edges and completed bags.

FIG. 8 is a partial sectional view showing an alternative embodiment.

Referring to the drawings in detail, wherein like numerals indicate like elements, there is shown in FIG. 1 a package designated generally as 10. The package 10 includes a bag in accordance with the present invention within which is disposed goods such as paper towels. The bag 12 has a handle 14 provided with a die cut opening 16. The handle 14 is welded to the bag 12 along the weld 18. The bag 12 has a front panel 20 and a rear panel 22 joined together by side welds 24 on opposite sides of the bag 12. Each of the panels 20, 22 forms approximately one-half of the top, bottom, and side walls of the package 10.

The bag 12 is made as follows. Referring to FIG. 2, a web 26 of a heat sealable polymeric plastic material is folded along fold line 28 so as to define a front panel 30 and a rear panel 32. Panel 32 is wider than panel 30 so as to define a lip 34 along the edge of the web opposite the fold line 28. The plastic material may be polypropylene, polyester, polyethylene, etc.

Referring to FIG. 2, a handle web or strip 36 is folded along fold line 38 so as to define equal front and rear panels 40, 42 respectively. Fold lines 28 and 38 are parallel to one other. The edges of the panels 40, 42 are welded to the panels 30, 32 respectively at the fold line 28 to thereby define the weld 18. See FIGS. 1, 3 and 4.

Referring to FIG. 5, the lip 34 is provided with holes 44 at spaced points therealong. At the same time or subsequently, the handle web 36 is die cut so as to provide notches 46 at spaced points therealong and the holes 16 are simultaneously die cut. The notches 46 have a depth so as to extend up to the weld 18.

Subsequently, the panels 30 and 32 are folded back on themselves so as to form a gusset defined by layers 43, 45 with the bottom edge of the gusset being defined by the fold lines 48 and 50 which are coextensive with the fold line 38. Thereafter, the webs are severed transversely at spaced notches 46 therealong and the panels 30, 32 are simultaneously joined to one other along the welds 24. The front panel 20 was part of the front panel 30 of the web 26. Similarly, the rear panel 22 of the bag was part of the rear panel 32 of the web 26. The side welds 24 are provided in the area of the notches 46 whereby the handle 14 has a length shorter than the length of the gussets. The handle 14 is also shorter than the length of the fold line 28.

The holes 34 on the lip 24 facilitate a stack of bags being supported on a wicket for use in connection with a filling machine. A product is introduced into the bag 12 between the panels 20, 22 at the end thereof remote from the gusset. Thereafter, the bag is stripped from the wicket at the filling machine and heat sealed so as to trim off the lip 34. The handle 14 facilitates carrying the package 10. In FIG. 1, the handle 14 is shown in a carrying position. Handle 14 in a normal position when not in a carrying position will not pivot about the weld 18 and lie flat on the top of the package 10.

The bag 12 of the present invention and the method of making the same provides for the use of different materials for the bag and handle whereby they may respectively be of different colors, different thicknesses of material, etc. The handle 14 may be transparent so that printed matter on the top of the package 10 may be read notwithstanding the fact that the handle 14 overlies the printing. Since the weld 18 extends along the entire length of the handle 14, the bag 12 is stronger and may contain heavier loads with a neat appearance for the package 10.

In FIG. 8, there is illustrated another embodiment of the bag 12'. The bag 12' is the same as the bag 12 except as will be made clear hereinafter. Hence, corresponding elements are identified by corresponding primed numerals.

The handle 14' is disposed in the gusset and is integral in one piece with the remainder of the bag 12'. The main web is folded so that the panels 30' and 32' overlap one another in the manner as described above with the fold line 38' extending along one edge of the web. Spaced from and parallel to the fold line 38', there is provided the weld 18'. This defines a handle web or strip. The handle strip is then die cut so as to provide notches corresponding to notches 46 and the finger openings corresponding to the openings 16. Thereafter, the panels 30', 32' are folded about the weld 18' to form the gusset before the side welds are applied to weld the side edges of the panels and delineate bags from the main web.

In connection with each embodiment of the present invention, the bags are produced substantially continuously with the webs stopping intermittently to facilitate application of the die cutting and welding steps. In each embodiment, no more than four layers are welded together at any of the welds. Hence, a wide range of thicknesses are available for the materials which may be utilized to make the bags 12 and 12'.

The present invention may be embodied in other specific forms without departing from the spirit or essential attributes thereof and, accordingly, reference should be made to the appended claims, rather than to the foregoing specification, as indicating the scope of the invention.

I claim:

1. A bag comprising generally rectangular front and rear panels overlying one another, a gusset of plastic material extending between the side edges of said panels along one end of said panels, said gusset having a fold line located between said panels and defining the inner boundary portion of said gusset, each panel having a fold line at said one end defining the outer boundary portion of said gusset, the other end of said panels being open to facilitate introducing goods into the bag, the side edges of said panels being connected together, a flat-sided handle disposed within said gusset between the inner and outer boundary portions and having a width substantially equal to the width of said gusset between said inner and outer boundary portions, said handle having a length shorter than the length of said gusset between said edges, said handle being welded along its inner boundary portion to only said gusset adjacent said fold line defining said inner boundary portion of said gusset, said handle being free to pivot at its inner boundary portion by being unattached to the remainder of said gusset between the fold lines of each panel from said inner boundary portion to said outer boundary portion of said gusset.

2. A bag in accordance with claim 1 wherein said handle is integral in one piece with said panels.

3. A bag in accordance with claim 1 wherein said handle is a discrete handle made from a material different from the material of said panels.

4. A bag in accordance with claim 1 wherein said handle includes two layers integral in one piece along a fold line parallel to and spaced from said weld.

5. A bag comprising front and rear generally rectangular panels of polymer plastic material integral in one piece at one end thereof in the form of a gusset, said gusset being disposed between welds joining the side edges of said panels, the other end of said panels being open to facilitate introducing goods into the bag, a flat handle disposed in said gusset, said handle having a length shorter than the length of said gusset between said side edges, said handle being two layers integral at a fold line along the outer edge thereof adjacent the outer end of the gusset, said handle having a width in a direction generally perpendicular to said fold line and which corresponds generally to the width of said gusset from its inner end to its outer end, the inner edge portion of said handle within said gusset and opposite said fold line being welded along its length to said gusset, said handle being free to pivot within the gusset from its welded inner edge portion and said handle having an opening to facilitate receiving a person's fingers therethrough.

* * * * *

UNITED STATES PATENT OFFICE

CERTIFICATE OF CORRECTION

PATENT NO. : 4,252,269

DATED : February 24, 1981

INVENTOR(S) : Harry R. Peppiatt

It is certified that error appears in the above-identified patent and that said Letters Patent are hereby corrected as shown below:

On the title page the assignee should correctly read -- Paramount Packaging Corporation --.

Signed and Sealed this

Sixteenth Day of June 1981

[SEAL]

*Attest:*

RENE D. TEGTMEYER

*Attesting Officer*

*Acting Commissioner of Patents and Trademarks*